US006513181B2

(12) United States Patent
Lisciani

(10) Patent No.: US 6,513,181 B2
(45) Date of Patent: Feb. 4, 2003

(54) DEVICE FOR MECHANICALLY CLEANING WIRE ROD FOR DRAWN METAL WIRES

(75) Inventor: Giulio Lisciani, Grottammare (IT)

(73) Assignee: R. Lisciani Trafilerie S.r.l., Grottammare (IT)

( * ) Notice: Subject to any disclaimer, the term of this patent is extended or adjusted under 35 U.S.C. 154(b) by 0 days.

(21) Appl. No.: 09/733,083

(22) Filed: Dec. 11, 2000

(65) Prior Publication Data

US 2002/0133891 A1 Sep. 26, 2002

(30) Foreign Application Priority Data

Dec. 23, 1999 (IT) ..... RN99A0037

(51) Int. Cl.[7] ..... B21C 43/04; B21C 1/00
(52) U.S. Cl. ..... 15/88; 15/104.04
(58) Field of Search ..... 15/88, 104.03, 15/104.04; 451/103, 109, 110

(56) References Cited

U.S. PATENT DOCUMENTS 3,916,469 A * 11/1975 Anthem et al.
4,205,407 A * 6/1980 King et al.
4,688,290 A * 8/1987 Hogg
5,946,757 A * 9/1999 Oliveira
6,023,807 A * 2/2000 Beissner
6,153,016 A * 11/2000 Rauch

FOREIGN PATENT DOCUMENTS

| | | |
|---|---|---|
| DE | 38 21 362 | 5/1989 |
| EP | 0 630 697 | 12/1994 |
| EP | 0 931 601 | 7/1999 |

* cited by examiner

*Primary Examiner*—Terrence R. Till
(74) *Attorney, Agent, or Firm*—Browdy and Neimark, P.L.L.C.

(57) ABSTRACT

Device for mechanically cleaning wire rod for profiled metal wires, comprising at least one press (3) with gripping jaws (4*a,* 4*b*) rotating about the wire rod (2) and supporting an abrasive material (5) , such as steel wool for example, arranged in one or more layers around the wire rod (2), pressed against it by the jaws (4*a,* 4*b*) and retained by the latter so as to prevent it being drawn along; operating members (6*a,* 6*b*) consisting of floating plates (8) joined together in an ordered manner in pairs so that each pair interacts autonomously with the abrasive material (5); means (7) for actuating the operating members (6*a,* 6*b*), able to modify the opening of the jaws (4*a,* 4*b*); means (10) for synchronizing the relative sliding movement of the plates (8) of each pair in the transverse direction with respect to the rod (2) and able to cause identical displacements of the said plates (8) in opposite directions.

11 Claims, 3 Drawing Sheets

DEVICE FOR MECHANICALLY CLEANING WIRE ROD FOR DRAWN METAL WIRES

BACKGROUND OF THE INVENTION

The present invention relates to a device for mechanically cleaning wire rod to be used in processes for the production of drawn metal wires.

"Wire rod" is used to refer to a semi-finished metallurgical product which is long and has a round cross-section and which, by means of gradual reduction of its cross-section during the technological process known as drawing, is reduced into the form of a wire.

The wire rod is hot-manufactured and is normally covered with oxides, hydroxides and calamine which must be removed before starting the actual drawing operation. If this operation were not carried out, poor quality wires would be obtained, the dies in which drawing is performed would be subject to rapid wear and there would be a significant restriction in the speed of the entire production process. The known operating methods for preparing wire rod for drawing are based on the use of chemical processes or, alternatively, mechanical processes. Although the use of chemical processes is able to ensure a higher level of cleaning quality, it nevertheless results in increased management and plant running costs and, in particular, creates serious problems with regard to environmental pollution. The use of mechanical processes is nowadays preferable because, although it results in an inferior cleaning quality of the wire rod, it involves lower plant management and operating costs and is less damaging for the environment.

PRIOR ART

Devices for mechanically cleaning wire rod, involving the use of a press comprising gripping jaws which support steel wool or another type of abrasive material wound around the wire rod, pressing it at the same time against the wire rod, are known and form the subject of previous patents in the name of the same Applicant. As the wire rod advances between the jaws, the steel wool removes the particles of oxide which cover the metal, but is not drawn along by the wire rod because the jaws retain it constantly, compensating for any wear with a gradual reduction in the space available therefor.

It is also useful, during mechanical cleaning, to prepare the surface of the wire rod with removal of metal particles using steel wool, in order to favour the subsequent operation consisting in fixing of a powdery lubricant. It is useful, however, to be able to modify, as required, the propensity of the wire rod to retain the lubricant depending on variable parameters, such as the chemical composition of the wire rod, the conditions for supplying of the semi-finished product, the type of lubricant and the drawing speed; and in particular it may be advantageous to maximize this propensity by increasing the length of the incisions formed on the surface of the wire rod, without modifying the longitudinal extension.

These further objects have been achieved with a device in which the jaws which grip the steel wool against the wire rod are able to rotate, at a variable speed, around the wire rod, forming helical grooves in the surface of the latter. Given a constant speed of feeding of the wire rod, the grooves have a spacing which is inversely proportional to the speed of rotation of the jaws, adjustment of which may therefore allow effective control over the propensity of the wire rod to retain the lubricant. The use of this device has, however, revealed certain drawbacks which are difficult to eliminate: in particular, the monolithic structure of the jaws results in an irregular contact surface with the steel wool which is formed, on the other hand, of loose material of a non-uniform nature, resulting in efficient pressure only in certain zones along the axis of the device. The need for mechanical balancing results in the use of jaw synchronization means located halfway along the axial extension of the jaws, with partial obstruction of the zone where the steel wool exerts its abrasive action on the wire rod. Finally, rotation of the jaws may result in twisting of the wire rod, resulting in compromises with negative effects in terms of operation of the device: for example, a necessary reduction in the speed of rotation or smaller dimensions of the device in the axial direction, i.e. parallel to the direction of feeding of the wire rod.

SUMMARY OF THE INVENTION

The object of the present invention is therefore to eliminate the drawbacks mentioned above. In accordance with the invention, this object is achieved by means of a device for mechanically cleaning wire rod, of the type indicated in the preamble of claim 1, in which the jaws which grip the steel wool, or other abrasive material, against the wire rod are supported by operating members consisting of adjacent and independent pairs of floating plates.

The main advantage obtained by means of the present invention consists in the fact that a uniform distribution, in the axial direction, of the pressure exerted by the jaws on the abrasive material is achieved and therefore the efficiency of the device is optimized. Moreover, the mechanical balancing, which is independent for each pair of plates, is advantageously achieved without obstructing the zone where the steel wool rubs against the wire rod; the structure of the plates may be lightened since their mutual independence replaces the considerable inertia of the monolithic device; as a result of the modularity of the jaws formed in this way, it is also possible to provide devices with dimensions satisfying the most widely varying requirements, keeping to a minimum the warehouse supplies, formed by plates which are all identical to each other. Finally, an important advantage consists in the fact that, for the same dimensions compared to the previously known device, the jaws may be formed by two sets of pairs of rotating plates which rotate in opposite directions to each other: in this way, twisting of the wire rod is compensated for and the surface of the latter has, etched on it, a double helix which will ensure a better propensity for retaining the lubricant and therefore an improved cleaning quality.

BRIEF DESCRIPTION OF THE DRAWINGS

The characteristic features of the invention, in accordance with the abovementioned objects, may be clearly determined from the contents of the claims below and the advantages thereof will emerge more clearly in the detailed description which follows, with reference to the accompanying drawings relating to a purely exemplary and non-limiting embodiment in which:

DETAILED DESCRIPTION OF THE PREFERRED EMBODIMENT (S)

Figure 2:
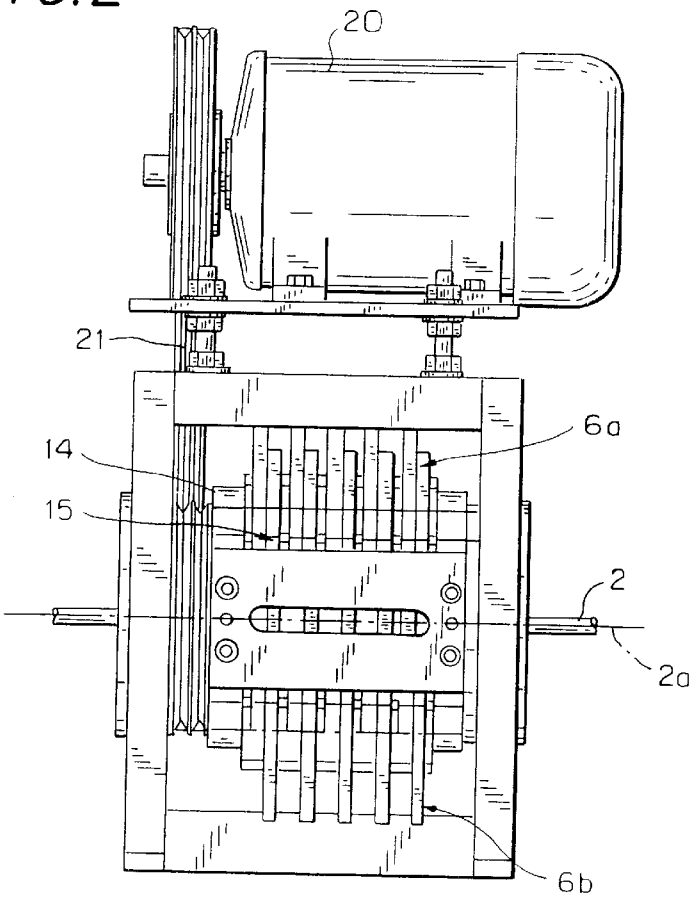
FIG. 2 shows a cross-sectional view, along the line II—II in FIG. 1, of the invention in a non-operative condition.
Figure 1:
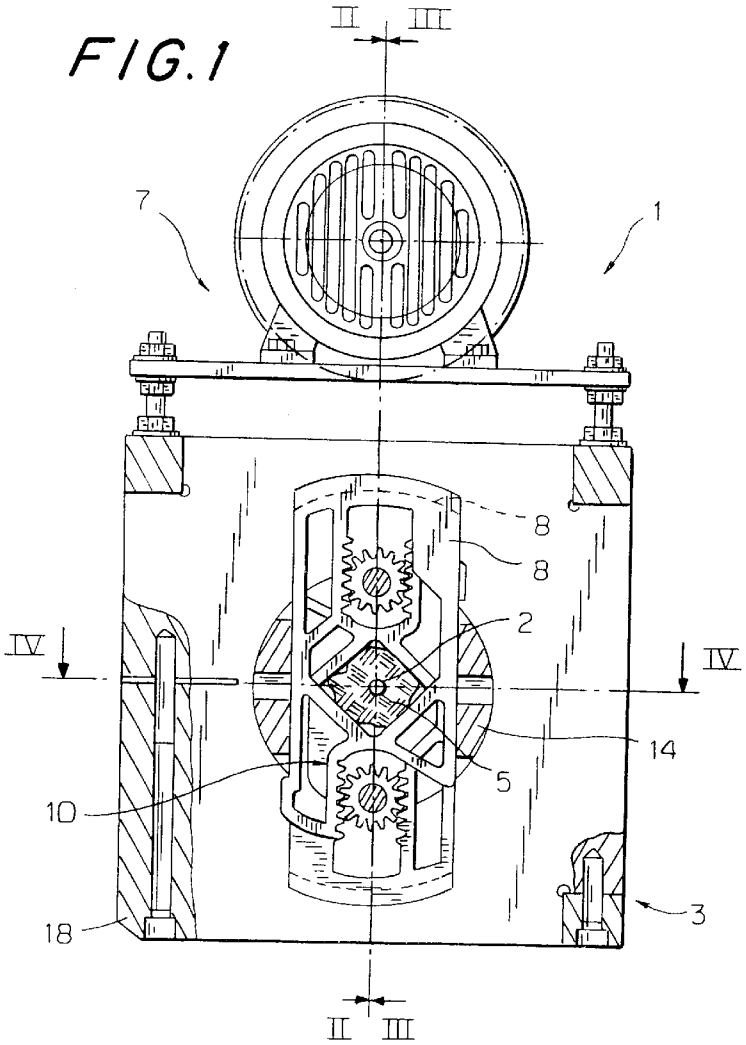
FIG. 1 shows a front view of the invention with some parts removed so that other parts may be seen more clearly.
Figure 4:
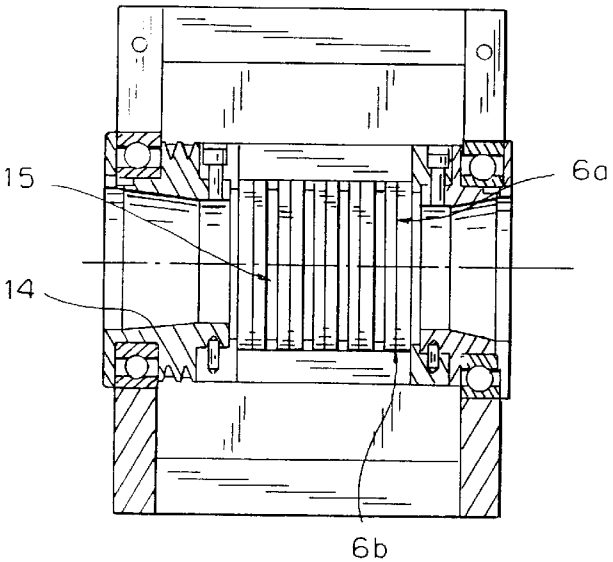
FIG. 4 shows a cross-sectional view of the invention along the line IV—IV in FIG. 1.
Figure 5:
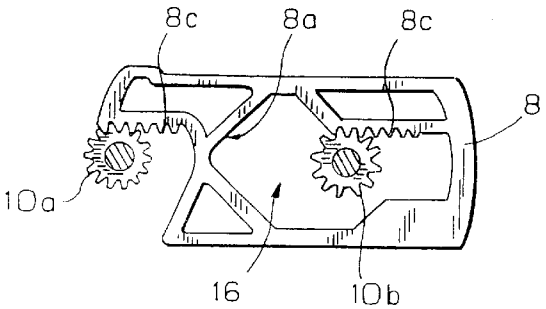
FIG. 5 shows some constructional details of the invention.

According to the figures in the accompanying drawings, the invention relates to a device for mechanically cleaning wire rod for drawn metal wires.

The device (1) comprises at least one press (3) essentially formed by a casing (18) inside which an internally hollow cylindrical body (14) is rotatably mounted, said cylindrical body interacting with the casing (18) at its opposite ends by means of revolving supports (19); the cylindrical body (14) has, mounted on it, operating members **(6*a*, 6*b*) which define and support the jaws (4*a*, 4*b*) for gripping the wire rod (2), which may rotate together with the cylindrical body (14) as a result of means (7) for actuating the operating members (6*a*, 6*b*) so as to cause a modification in the opening of the jaws (4*a*, 4*b*)**.

The wire rod (2) is free to advance with a rectilinear movement, in a direction **(2*a*) coinciding with the axis of the cylindrical body (14), towards a drawing plant located downstream of the device (1) in question. The gripping jaws (4*a*, 4*b*) support in a known manner an abrasive material (5), such as steel wool for example, wound in one or more layers around the wire rod (2), and press it against the latter, while retaining it so as to prevent it being drawn along as the wire rod (2) advances between the said jaws (4*a*, 4*b*)**.

The operating members **(6*a*, 6*b*) comprise a plurality of floating plates (8) which are joined together in pairs in an ordered and sequential manner. Each pair of plates (8) is separate from the adjacent pair of plates (8) so as to contribute autonomously to interaction of the jaws (4*a*, 4*b*) with the abrasive material (5)**.

Since the steel wool or other material in any case consists of loose material wound manually around the wire rod (2), its surface area and its density are significantly irregular and variable in the direction **(2*a*) of feeding of the wire rod (2). Owing to the division of the operating members (6*a*, 6*b*) into pairs of plates (8), the surface of the jaws (4*a*, 4*b*) may be adapted to the irregular surface of the abrasive material (5): in this way the contact surface area is increased, a uniform distribution of the pressure is ensured in the axial direction and a more efficient action of the jaws (4*a*, 4*b*) on the abrasive material (5), and therefore on the wire rod (2)**, is achieved.

The plates (8), which are all identical to each other, have an opening (16), the edge of which helps define the jaws **(4*a*, 4*b*) which, in turn, have a closed annular form with V-shaped operating surfaces (8*a*, 8*b*) delimiting the zone occupied by the abrasive material (5)** having dimensions which are not necessarily constant along the axis.

Figure 3:
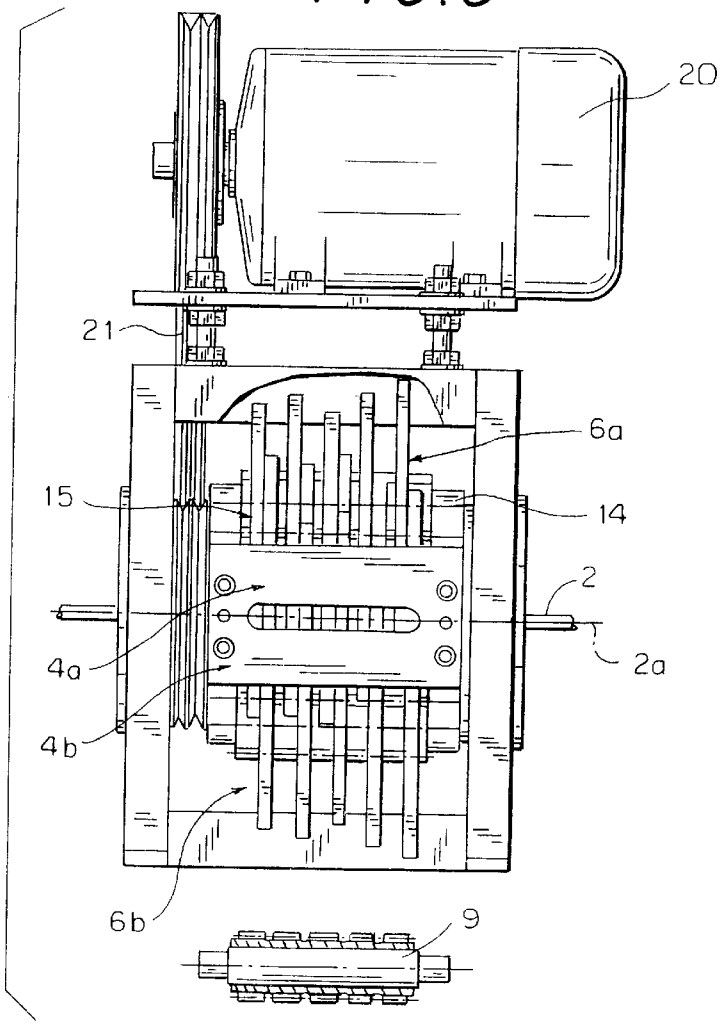
FIG. 3 shows a view of the invention, corresponding to the previous view, but in an operative condition.

The plates (8) are, in fact, free to move along prism-shaped guides (15) formed in the cylindrical body (14) and oriented in the radial direction: since the means (7) for actuating the operating members **(6*a*, 6*b*), and therefore the plates (8), exert on the plates (8) a same force couple in the opposite direction, during operation of the device (1) it is possible to observe, as shown in FIG. 3, mutual interpenetration of the jaws (4*a*, 4*b*) of the press (3)**, considered as a whole.

In the example of embodiment illustrated here, the actuating means (7) comprise a motor (20) and a drive belt (21) which is located between the motor (20) and the cylindrical body (14) of the press (3) and which transmits to the plates (8) a rotation which imparts centrifugal forces in opposite directions to the plates (8) of a same pair: these forces tend to move the plates (8) of a pair away from each other, reducing the opening of the jaws **(4*a*, 4*b*) which grip the abrasive material (5) wound around the wire rod (2)**.

In a preferred embodiment, the device (1) comprises means (10) for synchronizing the relative sliding movement of the plates (8) of each pair in a transverse direction with respect to the wire rod (2), said means being able to cause identical displacements of the said plates (8) in opposite directions. These synchronization means (10) comprise at least one gear wheel **(10*a*) interacting with the plates (8) along surfaces (8*c*) suitably shaped in the form of a rack so as to match the gear wheel (10*a*)**.

Although a single gear wheel **(10*a*) is sufficient to ensure the synchronism of the plates (8), the solution shown envisages the use of two gear wheels (10*a*, 10*b*), both interacting with rack-shaped surfaces (8*c*) of the plates (8) and arranged symmetrically with respect to the wire rod (2) so as to make the device (1) mechanically balanced. A single fixed support (9) keeps a whole series of similar gear wheels (10*a* or 10*b*)** aligned.

In order to prepare the device (1) for operation, first of all abrasive material (5) is wound manually in one or more layers around the wire rod (2) between the jaws **(4*a*, 4*b*) of the press (3). While in an inactive condition of the motor (20) the plates (8) of each pair are able to float freely along the guides (15) of the cylindrical body (14), when the motor (20) is started up, the drive belt (21) causes rotation of the cylindrical body (14) and, together therewith, the operating members (6*a*, 6*b*) formed by the plates (8). The centrifugal forces thus generated cause displacements, in opposite directions, of the plates (8) of each pair along the guides (15), producing greater gripping of the jaws (4*a*, 4*b*) against the abrasive material (5). The non-uniform distribution of the abrasive material (5) around the wire rod (2) and the mutual independence of the pair of plates (8) ensure that they interact in a varied manner and that therefore the jaws (4*a*, 4*b*) have an internally irregular profile or, in other words, the displacement on the guides (15) and gripping against the abrasive material (5) are not necessarily the same for all the pairs of plates (8)**.

Since in the meantime the wire rod (2) advances in the direction **(2*a*) of the axis of the press (3), the tangential action and the pressure—now substantially constant along the axis—of the abrasive material (5)** against it allow the oxide to be removed and the underlying surface thereof to be etched, with the formation of helical incisions therein.

Figure 6:
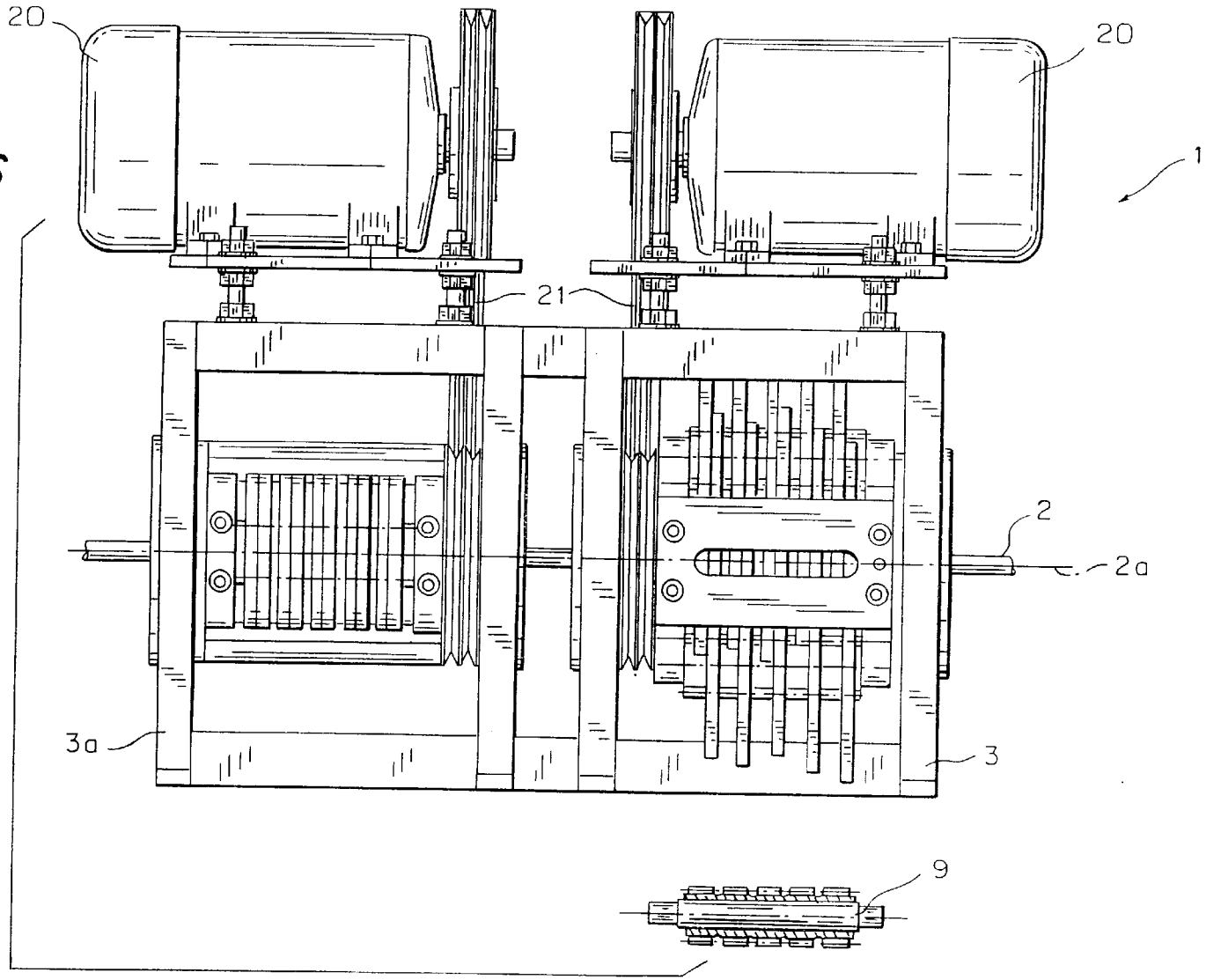
FIG. 6 shows a view, corresponding to those shown in FIGS. 2 and 3, of an alternative configuration of the invention.

The solution shown in FIG. 6 envisages the use of a second press **(3*a*), rotating in the opposite direction to the first press, so as to compensate for twisting of the wire rod (2) and so as to etch the surface thereof with a double helix which will subsequently allow better retention of the lubricant. Similarly, the device (1) could envisage the use of a set of presses (3)** arranged in series, alternately rotating in both directions.

The invention thus conceived may be subject to numerous modifications and variants, all of which fall within the scope of the inventive idea. Moreover, all the details may be replaced by technically equivalent elements.

In practice, modifications and/or improvements are obviously possible, provided that they fall within the scope of the following claims.

What is claimed is:

1. Device for mechanically cleaning wire rod for drawn metal wires, comprising at least one press (3) with gripping jaws (4*a,* 4*b*) which are able to rotate about the wire rod (2) and which support an abrasive material (5) wound in one or more layers around the wire rod (2), wherein the abrasive material (5) is pressed against the wire rod (2) as the wire rod (2) advances between the jaws (4*a,* 4*b*) and retained so as to prevent being drawn along by the wire rod (2); operating members (6*a,* 6*b*) supporting the jaws (4*a,* 4*b*) and guided slidably in a transverse direction with respect to the wire rod (2); means (7) for actuating the operating members (6*a,* 6*b*), able to modify the opening of the jaws (4*a,* 4*b*), wherein the operating members (6*a,* 6*b*) comprise a plurality of floating plates (8) which are joined together in an ordered manner in pairs so that each pair of plates (8) contributes autonomously towards interaction of the jaws (4*a,* 4*b*).

2. Device as claimed in claim 1, wherein the jaws (4*a,* 4*b*) have matching operating surfaces (8*a,* 8*b*) designed to surround, in combination, the wire rod (2) which passes through the press (3).

3. Device as claimed in claim 1, wherein the means (7) for actuating the operating members (6*a,* 6*b*) exert a same force couple in opposite directions on the plates (8).

4. Device as claimed in claim 3, wherein the actuating means (7) comprise a motor (20) and a drive belt (21) located between the motor (20) and the press (3), which are able to impart to the plates (8) a rotation which causes centrifugal forces in opposite directions on the plates (8) of a same pair.

5. Device as claimed in claim 1, comprising means (10) for synchronizing the relative sliding movement of the plates (8) of each pair in a transverse direction with respect to the wire rod (2), able to cause identical displacements of the said plates (8) in opposite directions.

6. Device as claimed in claim 5, wherein said synchronization means (10) comprise at least one gear wheel (10*a*) interacting with correspondingly shaped surfaces (8*c*) of the plates (8).

7. Device as claimed in claim 6, comprising a single fixed support (9) for each series of similar gear wheels (10*a,* 10*b*).

8. Device as claimed in claim 5, wherein said synchronization means (10) comprise two gear wheels (10*a,* 10*b*) interacting with correspondingly shaped surfaces (8*c*) of the plates (8) and arranged symmetrically with respect to the wire rod (2) so that the device (1) is mechanically balanced.

9. Device as claimed in claim 7, comprising a single fixed support (9) for each series of similar gear wheels (10*a,* 10*b*).

10. Device as claimed in claim 1, comprising at least one second press (3*a*) rotating in an opposite direction to the first press (3) so as to compensate for twisting of the wire rod (2).

11. Device as claimed in claim 10, comprising a series of presses (3) alternately rotating in both directions.

* * * * *